US010538255B2

(12) United States Patent
McWhorter et al.

(10) Patent No.: US 10,538,255 B2
(45) Date of Patent: Jan. 21, 2020

(54) TANK CAR HEATING DEVICE AND METHOD

(71) Applicants: Thomas R. McWhorter, Savannah, GA (US); Darlene Vincent, Rincon, GA (US)

(72) Inventors: Thomas R. McWhorter, Savannah, GA (US); Darlene Vincent, Rincon, GA (US)

( * ) Notice: Subject to any disclaimer, the term of this patent is extended or adjusted under 35 U.S.C. 154(b) by 1056 days.

(21) Appl. No.: 14/812,261

(22) Filed: Jul. 29, 2015

(65) Prior Publication Data

US 2016/0031453 A1 Feb. 4, 2016

Related U.S. Application Data

(60) Provisional application No. 62/030,122, filed on Jul. 29, 2014.

(51) Int. Cl.
*B65D 88/74* (2006.01)

(52) U.S. Cl.
CPC ..... *B61D 5/04* (2013.01)

(58) Field of Classification Search
CPC ..... B61D 5/04
See application file for complete search history.

(56) References Cited

U.S. PATENT DOCUMENTS 4,480,370 A * 11/1984 Loevinger ..... B61D 5/04 105/360
5,020,447 A * 6/1991 Loevinger ..... B61D 5/04 105/360
5,058,511 A * 10/1991 Loevinger ..... B61D 5/04 105/358
6,347,589 B1 * 2/2002 Loevinger ..... B61D 5/04 105/358

* cited by examiner

*Primary Examiner* — Jason C Smith
(74) *Attorney, Agent, or Firm* — Cantor Colburn LLP

(57) ABSTRACT

A tank car heating device is provided, which comprises a heat exchanger configured to insert through an entry point, e.g., a manway, of a tank car in communication with a heat source.

11 Claims, 2 Drawing Sheets

TANK CAR HEATING DEVICE AND METHOD

CROSS-REFERENCE TO RELATED APPLICATIONS

This application claims the benefit of U.S. provisional patent application Ser. No. 62/030,122 filed Jul. 29, 2014, the entire contents of which are incorporated herein by reference.

BACKGROUND

The present disclosure relates to a tank heating device that is configured to insert into a tank car through a point of entry, such as a confined entry point, a manway of a tank car, etc., and provide contaminant free heating for such interior portions.

Canadian Rail Authorities require thermographic inspection of all insulated pressure cars. These cars typically transport Liquefied Petroleum Gas (LPG). It is expected that thermographic inspection to become a requirement in the USA.

Current practice is to heat cars with direct steam injection. Steam injection generates condensate inside the cars which must be removed and disposed of as processed wastewater. Once the condensate is removed, personnel must enter the cars and complete drying with cloths.

Steam injection is a customary step during the degassing process. However, when degassing is accomplished through a vacuum system, steam injection is not required; but the cars require heating for thermographic inspection.

What is needed in the art is tank car heating system that can heat or regulate temperature of the tank car without introduction of contaminants.

SUMMARY

The above described and other problems and disadvantages of the prior art are overcome and alleviated by the present exemplary tank car heating device, which comprises a heat exchanger configured to insert through an entry point, e.g., a manway, of a tank car in communication with a heat source.

In exemplary embodiments, the heater includes a fan and a cylindrical shroud that houses the heat exchanger plates. The fan is mounted on the assembly and forces air through the assembly and discharges across a deflector, which directs the air along the floor of the car towards the car ends. Air is heated and re-circulated inside the car.

In exemplary embodiments, the heat exchanger is made up of concentric cylinders of hollow, sandwiched plates. The top of the assembly is a plate, which covers the manway during heating and supports the whole assembly while it is suspended inside the car. The plate has electrical connection to power the fan, hose connector for steam (or hot water), hose connector for condensate return (or hot water return), and lifting eyes.

The above-discussed and other features and advantages of the present invention will be appreciated and understood by those skilled in the art from the following detailed description and drawings.

BRIEF DESCRIPTION OF THE DRAWINGS

Referring now to the drawings, wherein like elements are numbered alike in the following FIGURES.

DETAILED DESCRIPTION

As was noted above, the present disclosure relates to a tank heating device that is configured to insert into a tank through a confined entry and heat interior portions of the tank. The remainder of the specification will refer to an exemplary tank, exemplary tank car or an exemplary rail tank car. However, it should be recognized that the present invention is not so limited, and the term "tank" encompasses any enclosed vessel with an entry point (such as a confined entry, a manway access, etc.). Such "tank" may be used to transport commodities, e.g., on rails, roads, waterways, etc. Such "tank" may also refer to stationary tanks used to store commodities. The "tank" may have any lower surface geometry, e.g., flat, sloped, curved, irregular, etc. The "tank" may also have one or more entry point(s) in any convenient location, including a top or side surface thereof. Thus, the present disclosure is not restricted to exemplary embodiments described below, but instead relates to heating of "tanks."

Figure 1:
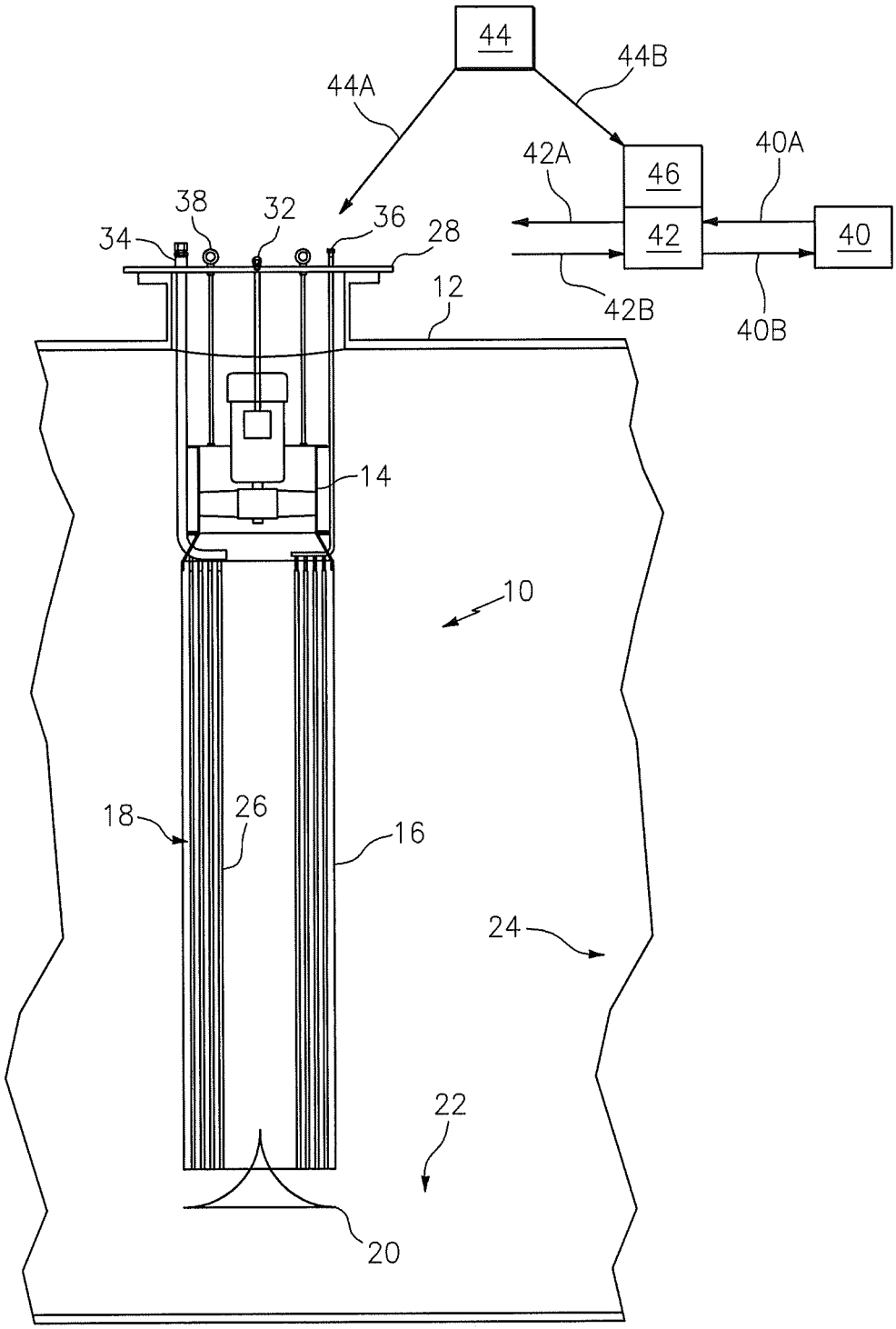
FIG. 1 is a side section view of an exemplary device for heating a tank.
Figure 2:
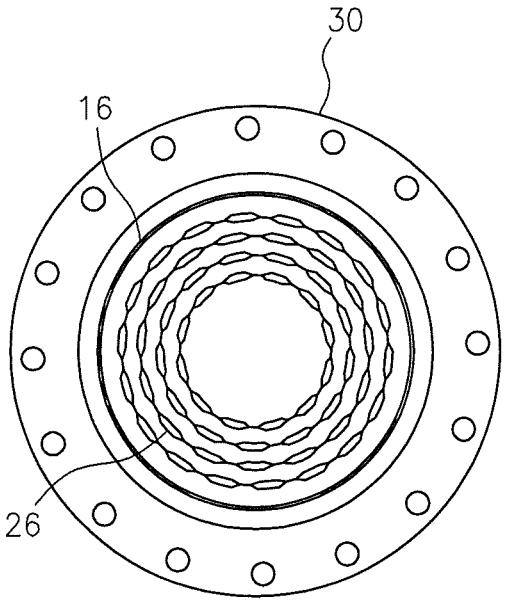
FIG. 2 is a top plan view of the device of FIG. 1.

FIGS. 1 and 2 illustrate an exemplary embodiment of a heating device in accordance with the present invention in side and top elevation views, respectively. In this exemplary embodiment, the tank car heating device, shown generally at 10, is utilized within a rail tank car 12 and comprises a fan 14 and a cylindrical shroud 16 that houses a heat exchanger, shown generally at 18. The fan 14 is mounted on the assembly and forces air through the assembly, which air discharges across a deflector 20. The deflector 20 directs the air along the floor (shown generally at 22) of the car 12 towards the car ends, shown generally at 24.

In exemplary embodiments, air is heated and re-circulated inside the car. The exemplary heat exchanger 18 comprises concentric cylinders of hollow, sandwiched plates 26. The top of the assembly is a plate 28 that covers the manway 30 (or other opening) during heating and supports the whole assembly while it is suspended inside the car 12. The plate 28 has electrical connection 32 to power the fan 14, hose connector 34 for steam (or hot water), hose connector 36 for condensate return (or hot water return), and lifting eyes 38.

The exemplary heat source may be steam, hot water or other material and may, in exemplary embodiments, be provided by a dedicated boiler 40. Such boiler 40 may be mounted outside the car 12 and outside the hazardous classification area. Steam (or hot water) may be piped from the boiler 40, as shown in exemplary line 40A, up to valves and hose connectors. In exemplary embodiment, an intermediate work platform 42 provides connection to the heater assembly 10 via paths 42A and 42B.

In exemplary embodiments, condensate (or hot water return) from the heat exchanger 18 can be returned to the boiler 40, as shown in exemplary line 40B, via hose connections, piping, and a pump. As we have noted, in exemplary embodiments, hoses extend from the exemplary work platform 42 to the heater assembly 10.

A hoist 44 may be used lift the heater assembly 10 to the car 12. When heater assembly 10 is not in use (in position 44A), it can be placed at exemplary position 44B in a rack 46 near or on the exemplary work platform 42.

In exemplary embodiments, the heater is configured to heat and re-circulate air inside the car to heat the car shell, e.g., to a required differential of 20 degrees F. Exemplary embodiments can heat the car efficiently, e.g., within 1-2 hours.

Exemplary embodiments provide an external device that may be inserted through a confined space, e.g., an 18" diameter manway 30. Exemplary embodiments also provide heat with no contamination of car interior.

The present disclosure also relates to a method of utilizing exemplary components above, including one or more of: use of a heat exchanger inserted through an entry point of a tank car in communication with a heat source; use of a fan and heat exchanger plates to force heated air into the tank car; use of a deflector to direct air along portions of the tank car, e.g., across the floor and towards the car ends; use of a hoist to position the assembly in place within a tank car or to remove the assembly to an uninstalled position, e.g., a rack on or near a work platform; remotely providing the heat source via connections to the heat exchanger, including in exemplary embodiments use of an intermediate work platform and/or a pump and hose connections; and connecting the assembly via a plate, which is configured to cover a manway during assembly, support the assembly thereon, and provide electrical connection for a fan and hose connections for supply and return of the heat (e.g., steam or hot water) and, in exemplary embodiments, one or more hoisting points.

It will be apparent to those skilled in the art that, while exemplary embodiments have been shown and described, various modifications and variations can be made to the tank car heating device and method of making disclosed herein without departing from the spirit or scope of the invention. Also, the exemplary implementations described above should be read in a non-limiting fashion, both with regard to construction and methodology. Accordingly, it is to be understood that the various embodiments have been described by way of illustration and not limitation.

What is claimed is:

1. A tank car heating device, comprising:

a heat exchange assembly, configured with a diameter to insert through an entry point of a tank car and in communication with an external heat supply, the heat exchange assembly configured to force heated air through the heat exchange assembly and into an internal space of said tank car, wherein said heat exchange assembly is configured to lower through a manway access in said tank car and wherein said heat exchange assembly is configured with a mounting plate, said mounting plate configured to support said heat exchange assembly on said manway access, the mounting plate also configured with electrical and heat exchange connections.

2. A tank car heating device as in claim 1, wherein said heat exchange assembly is configured with a fan positioned to direct air over elements of said heat exchange assembly and into said internal space.

3. A tank car heating device as in claim 2, wherein said heat exchange assembly further comprises a deflector configured to direct air within said internal space.

4. A tank car heating device as in claim 3, wherein said deflector directs air across the floor of said tank car towards an end wall of said tank car.

5. A tank car heating device as in claim 1, wherein said mounting plate comprises at least one hoist point configured to attach to a hoist for lowering or raising of said heat exchange assembly relative to said manway access.

6. A tank car heating device as in claim 1, further comprising a workstation disposed between said manway access and said heat source, the workstation providing heat source and heat exchange connections as well as a rack for storage of said heat exchange assembly in an uninstalled position.

7. A tank car heating device as in claim 1, wherein said heat exchange assembly comprises a fan, a cylindrical shroud housing heat exchanger plates and a deflector configured to direct air heated by said heat exchanger plates and forced by said fan into said internal space.

8. A tank car heating device as in claim 7, wherein said heat exchange assembly comprises concentric cylinders of hollow, sandwiched plates, with connections for heat delivery and return.

9. A tank car heating device as in claim 1, wherein said external heat supply is one of steam and hot water.

10. A tank car heating device as in claim 1, wherein said heat exchange assembly is configured to heat and re-circulate air inside said tank car to heat the tank car shell to a differential of 20 degrees Fahrenheit.

11. A tank car heating device as in claim 10, wherein said heat exchange assembly is configured to heat said tank car shell to said differential in less than about two hours.

* * * * *